United States Patent [19]

Kamp

[11] 4,171,779

[45] Oct. 23, 1979

[54] METHOD AND DEVICE FOR REMOVING FULLY WOUND CHEESES IN A TEXTILE MACHINE

[75] Inventor: Heinz Kamp, Rickelrath, Fed. Rep. of Germany

[73] Assignee: W. Schlafhorst & Co., Mönchen-Gladbach, Fed. Rep. of Germany

[21] Appl. No.: 617,391

[22] Filed: Sep. 29, 1975

[30] Foreign Application Priority Data

Oct. 1, 1974 [DE] Fed. Rep. of Germany ..... 2446739

[51] Int. Cl.[2] ..... B65H 54/02

[52] U.S. Cl. ..... 242/35.5 A

[58] Field of Search ..... 242/35.5 A, 35.5 R, 242/35.6 R; 57/53, 268–271; 198/24, 27, 77, 177 R, 177 Y, 680, 678, 482, 483, 400

[56] References Cited

U.S. PATENT DOCUMENTS

| | | | |
|---|---|---|---|
| 1,907,894 | 5/1933 | Stevens et al. | 198/177 R |
| 2,306,871 | 12/1942 | Esser et al. | 242/35.6 R |
| 2,431,618 | 11/1947 | Rayburn et al. | 198/177 R |
| 3,386,557 | 6/1968 | Ross et al. | 198/400 |
| 3,605,983 | 9/1971 | Oldershaw | 198/400 |
| 3,791,126 | 2/1974 | Kose | 242/35.5 A |
| 3,906,712 | 9/1975 | Miyazuki et al. | 242/35.5 A |
| 3,913,853 | 10/1975 | Raasch | 242/35.5 A |

*Primary Examiner*—Richard E. Aegerter
*Assistant Examiner*—John W. Shepperd
*Attorney, Agent, or Firm*—Herbert L. Lerner

[57] ABSTRACT

Method of removing fully wound cheeses from a textile machine having machine units located on both sides of a symmetry plane and respectively formed of rows of work stations, which includes gripping respective fully wound cheeses by means of a coil exchanging device capable of traveling in the direction in which the symmetry plane extends, bringing the cheeses into the symmetry plane, raising the cheeses, transporting the cheeses along the symmetry plane above the work stations, and unloading them at the end of the textile machine, and device for carrying out the foregoing method.

3 Claims, 10 Drawing Figures

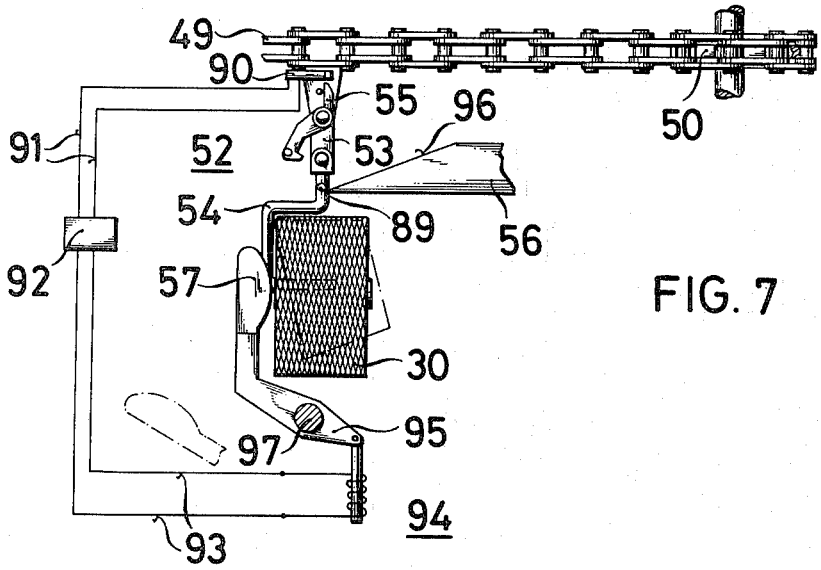
FIG. 7
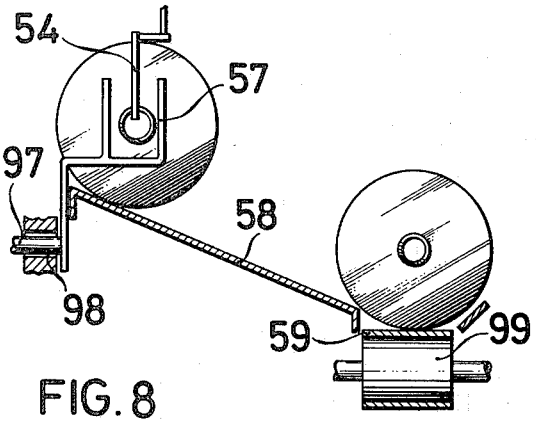
FIG. 8
FIG. 9
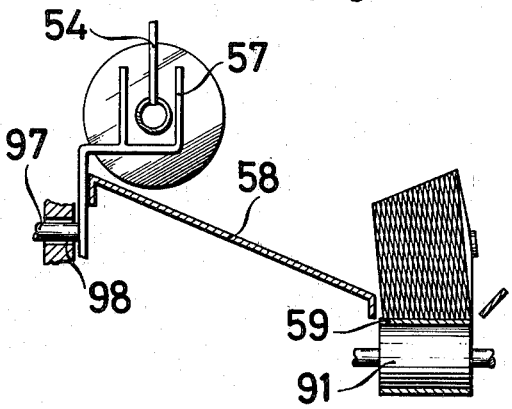
FIG. 10
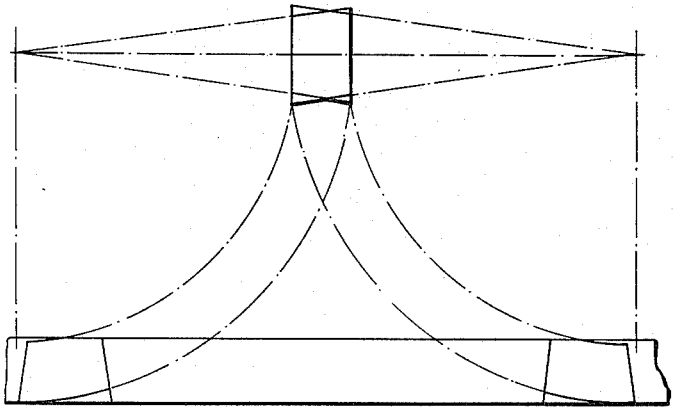

METHOD AND DEVICE FOR REMOVING FULLY WOUND CHEESES IN A TEXTILE MACHINE

The invention relates to a method for removing fully wound cheeses or cross-wound coils from machine units of a textile machine that are disposed at both sides of a symmetry plane and are formed of rows of work stations, and a device for carrying out the method.

In rows of work stations, such as spinning and winding stations, for example, of textile machines, coil exchanging devices have already been known heretofore, which respectively seize the fully wound cheese that is to be removed and place it on a conveyor belt installed at the rear side of the machine. Difficulties arise thereby because of the reduced space when the textile machine is formed of machine units disposed on both sides of a symmetry plane. In such case, work stations are located at the servicing and transport passages remaining between the machines, so that no place is available any more for a particular coil conveyor belt.

For this reason, no automatic coil exchanging device optimally using the space has become known heretofore for machine units disposed on both sides of a symmetry plane.

It is an object of the invention, accordingly, to provide a method and device for removing cheeses fully wound at the working stations without limiting or hindering the servicing and transport paths located between the textile machines.

With the foregoing and other objects in view, there is provided in accordance with the invention, a method of removing fully wound cheeses from a textile machine having machine units located on both sides of a symmetry plane and respectively formed of rows of work stations, which comprises gripping respective fully wound cheeses by means of a coil exchaning device capable of traveling in the direction in which the symmetry plane extends, bringing the cheeses into the symmetry plane, raising the cheeses, transporting the cheeses along the symmetry plane above the work stations, and unloading them at the end of the textile machine.

In accordance with another mode of the method of the invention, the cheeses are advanced by means of a gripper to an elevator trough of a coil elevator connected to the coil exchanging device, the cheeses are raised until they are in vicinity of a transport device, the coils are seized with a transport element of the transport device and are further transported along the symmetry plane in substantially horizontal direction above the winding stations.

Since, with the method of the invention, the cheeses are removed from the machine units both from the left-hand as well as the right-hand sides thereof, whereby the thread ends of the cheeses lie at one time to the rear in transport direction, and at another time to the front in transport direction, there is provided in accordance with a further mode of the method of the invention that the removed cheeses are unloaded at the end of the textile machine by means of an unloading device in such a manner that the thread ends thereof always lie at the same side independently of the machine unit from which the respective cheese originates.

For carrying out the foregoing method of the invention, a device has been provided, comprising a coil exchanging device, means forming a travel path for the coil exchanging device, a transporting device for transporting coils to the textile machine, and means forming a transport path for the transporting device.

The coil exchanging device must be capable of carrying out the coil exchange both for the left-hand as well as the right-hand side machine units. Therefore, in accordance with an additional feature of the invention, the coil exchanging device comprises elements for removing fully wound cheeses and for exchanging the cheeses for unwound coil cores, the elements being provided in doubles and respectively disposed similarly on both sides of the symmetry plane of the machine units.

Since the fully wound cheeses are transported above the winding stations, there is proposed in accordance with yet another feature of the invention that the coil exchanging device comprises at least one coil elevator provided with a take-up trough for taking-up and transferring, respectively, a fully wound cheese. In accordance with an added feature of the invention, the coil elevator has a lifting height greater than the diameter of a fully wound cheese. Thereby, the coil exchanging device, of necessity, is capable of traveling with a previously taken up but not yet raised cheese below the stationary though not yet unloaded transport device.

Since the operations of the coil exchange and of the coil transport ought not to hinder one another, in accordance with another feature of the invention, the transport device has a transport speed greater than the travel speed of the coil exchanging device.

In accordance with an additional feature of the invention, the transport device comprises a link chain, and transport elements disposed in mutually spaced relationship thereon.

In accordance with yet a further feature of the invention, the device includes coil take-up hooks articulatingly suspended from the transport elements, and blocking pawl means for disposing the hooks in rest position up to above a substantially horizontal plane passing through the highest point of a fully wound cheese having maximal diameter and having been raised by the coil elevator.

To introduce the coil transport, further in accordance with the invention, a releasing lever is located on the coil elevator, the releasing lever in the upper terminal setting of the coil elevator, releasing the blocking pawl means, of the next disposed oncoming transport element and thereby bringing it out of rest position into relay position. The other transport elements that are not in ready setting accordingly remain raised so high that they do not hinder the coil exchanging operation and the action of the coil lift.

In accordance with another feature of the invention, an unloading and coil roll-off device and means having a roll-off surface to a conveyor belt are located at the end of the transport device. The unloading device comprises a stationary slide skid engaging below a stop pin of the coil transport hook, the slide skid having an upwardly sloping run-up surface and a coil detent adjustable upwardly against the rear side of the coil at the instant the coils travel past.

Since most cheeses are conical, in accordance with the invention, the roll-off surface extends transversely to the original transport direction and is directed at the downward inclination, and the conveyor belt located at the end of the roll-off surface extends parallel to the original transport direction.

On the roll-off surface, conical coils can roll-off onto the conveyor belt only so that the narrower side of the coil winding thereof is in direction of the roll-off surface. Thus, the thread ends of the coils unloaded onto the conveyor belt are advantageously always on the same side.

The main advantages of the invention are especially in that the servicing passages between the machines transport devices are held free and thereby also, the danger of accident resulting from transport devices is avoided. The entire installation area of the machine room or hall is better utilized, the manual servicing of the machines is simplified and the operating costs are reduced.

A further advantage of the invention is that a traveling coil exchaning device simultaneously assumes duties of the coil transport and that the transported conical cheeses are put away automatically, oriented uniformly and independently of which of the machine units the individual coil stems from.

Other features which are considered as characteristic for the invention are set forth in the appended claims.

Although the invention is illustrated and described herein as embodied in method and device for removing fully wound cheeses in a textile machine, it is nevertheless not intended to be limited to the details shown, since various modifications may be made therein without departing from the spirit of the invention and within the scope and range of equivalents of the claims.

The invention, however, together with additional objects and advantages thereof will be best understood from the following description when read in connection with the accompanying drawings, in which:

FIG. 7 is a fragmentary view of FIG. 5 showing the device of the invention in a different mode of the method of the invention;

FIGS. 8 and 9 are similar diagrammatic and sectional views of details of the device in two different modes of the method of the invention; and FIG. 10 is a diagrammatic representation of the roll-off of conical cross-wound coils from the transporting device onto the conveyor belt of the device of the invention.

Figure 1:
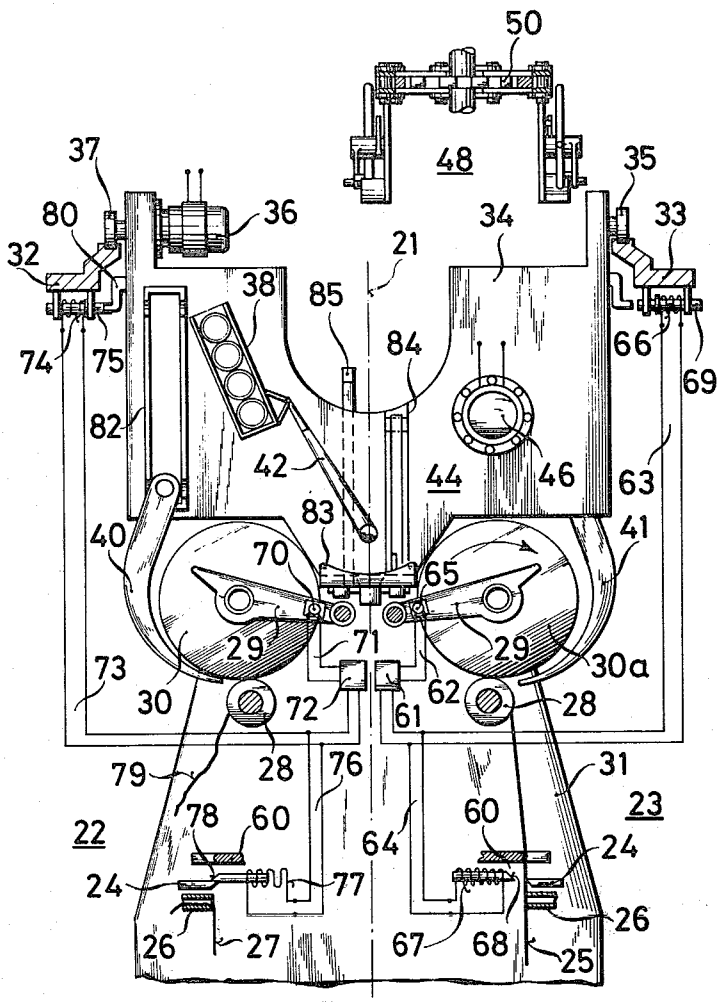
FIG. 1 is a diagrammatic front elevational view, partly in section, of a pair of machine units of a textile machine shown on the left-hand and right-hand sides, respectively, of a symmetry plane and assembled with the device for removing fully wound cheeses or cross-wound coils according to the invention.

Referring now to the drawings and first, particularly, to FIG. 1 thereof, there are shown machine units 22 and 23, namely, made up of winding stations of a textile machine, that are located on both sides, respectively, of a symmetry plane represented by a broken vertical line 21. Only a single winding station of the multiplicity thereof that are arranged in rows to form a single machine is, of course, visible at each side of the end view shown in FIG. 1.

Each of the winding stations has a pair of shears 24 for severing a supplied thread 25, a suction device 26 for gripping an end 27 of a thread that has been freshly supplied under certain circumstances after the previously supplied thread 25 had been severed, a winding roller 28 and a winding frame 29 for holding a respective cross-wound coil or cheese 30, 30*a*, that is pressed against the winding roller 28 and is set into rotation by the winding roller 28, which is suitably driven by conventional non-illustrated means. At the narrow sides thereof, the machine units 22 and 23 are confined or bounded by machine frames 31.

The thread-supplying parts of the textile machine are not illustrated since they are not essential to the invention and, in any event, may be of conventional construction and well within the knowledge of anyone having ordinary skill in the art of textile machinery. Accordingly, the machine frames 31 are shown broken-away at the lower edge thereof as illustrated in FIGS. 1, 3 and 4.

Figure 3:
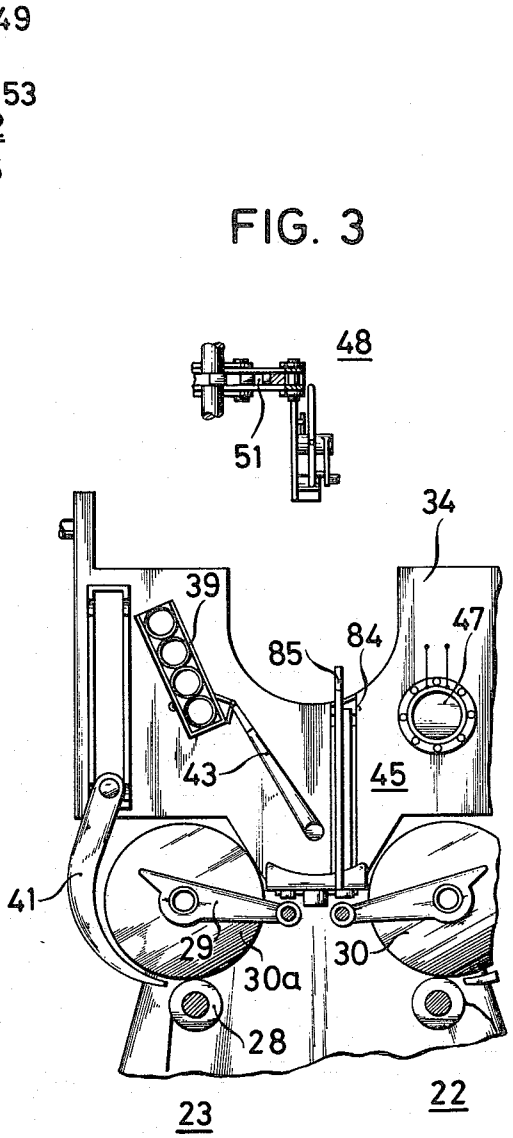
FIG. 3 is a rear elevational view of FIG. 1, partly broken away.
Figure 2:
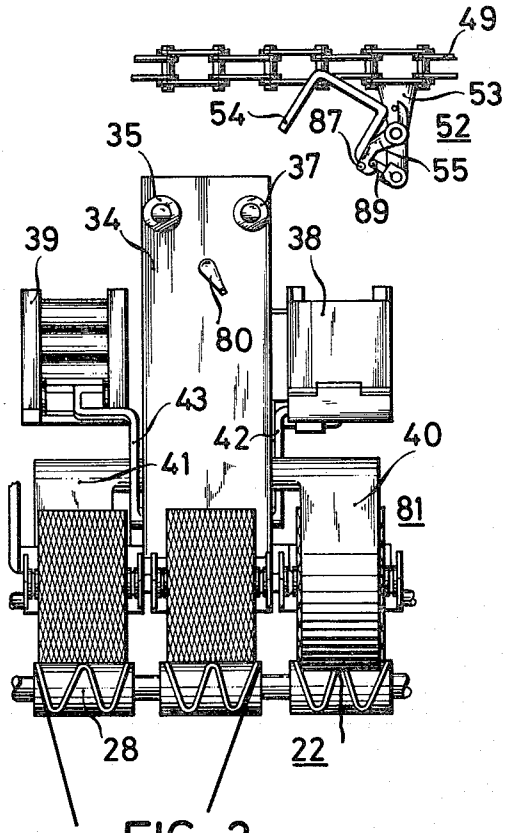
FIG. 2 is a side view of FIG. 1 wherein the device of the invention is shown extending over three winding stations of the textile machine.
Figure 4:
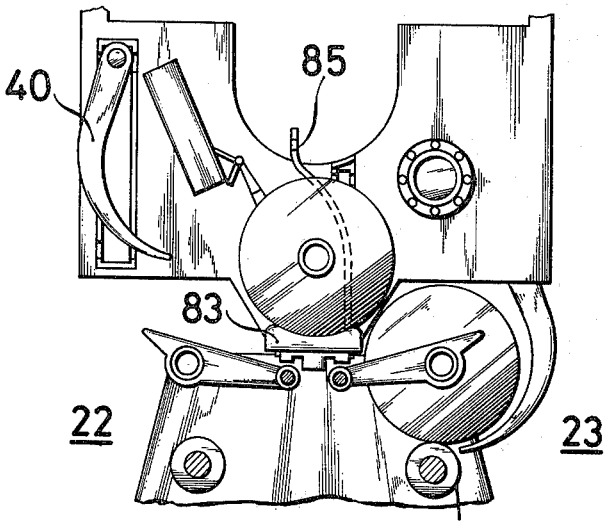
FIG. 4 is another view of FIG. 1 showing additional details of the device of the invention.

As is readily apparent from FIGS. 1 to 3, rails 32 and 33 are mounted above the winding stations of the machine units 22 and 23, and a coil exchanging device 34 is capable of traveling on and along the rails 32 and 33. For this purpose, the coil exchanging device 34 has three bogie wheels or idler or undriven rollers 35 and a driving roller 37 driven by an electric motor 36. In addition thereto, the coil exchanging device 34 shown in FIGS. 1 to 6 also includes two coil core magazines 38 and 39, two grippers 40 and 41, two coil core delivery devices 42 and 43, two coil elevators 44 and 45 and two drive motors 46 and 47 for driving the elevators 44 and 45 and the coil exchanging automatic system, the details of which are not illustrated and are not essential, as such, to the invention.

A transporting device 48 for fully wound cheeses is located above the coil exchanging device 34 and is formed primarily of an endless link chain 49, two chain wheels or sprockets 50 and 51 and transport elements 52 fastened to individual links of the chain 49. Each transport element 52 is made up of a strap 53, a coil transporting hook 54 articulatingly suspended from the lower end of the strap 53, as viewed in FIG. 2, and having a stop pin 89 extending therefrom, and a pawl 55 articulatingly suspended from the middle of the strap 53. Transportation of the coils, as is apparent from FIG. 1, is effected along a run which extends along the symmetry plane 21, while the return run of the endless chain 49 is in a direction parallel to the symmetry plane 21 i.e. perpendicular to the plane of the drawing in FIG. 1.

In FIGS. 7 to 9, there is shown the unloading and coil roll-off device of the invention which is located at the end of the coil transport path. The unloading and coil roll-off device is formed primarily of the stationary slide skid 56 which engages the coil transport hook 54 below the stop pin 89 thereof, a coil detent or abutment member 57 which is displaceable into elevated position thereof against the rear of a coil at the instant during which the coil passes by, a roll-off surface member 58 and a conveyor belt 59.

Figure 6:
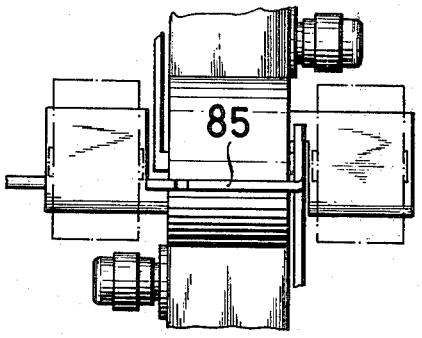
FIG. 6 is a top plan view of FIG. 5, partly broken away.
Figure 5:
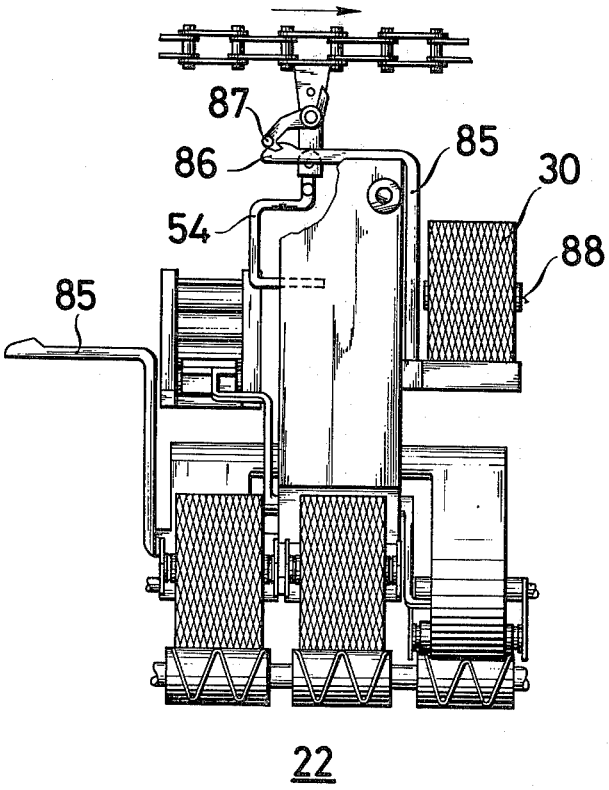
FIG. 5 is another view of FIG. 2 showing further details of the device.

The coil exchanging and transporting devices 34 and 48, respectively, are provided in doubles, as can readily be seen from FIGS. 2, 5 and 6. Thereby, coil removal at the right-hand side and the left-hand side of the symmetry plane 21, as viewed in FIG. 1, is afforded.

The visible winding station of the machine unit 23 shown in FIGS. 1, 3 and 4 is, in fact, in active operation. The continuously supplied thread 25 is drawn past a then inoperative suction device 26, the open shears 24 and a thread monitor or guide 60 by the winding roller 28 and is fed to the cheese or cross-wound coil 30*a* rolling on the winding roller 28. An approach switch 65 connected by a double electric line to switching gear 61 is not yet switched on because the cheese 30*a* has not yet attained the maximal or full winding thereof. The knife blade 68 of the shears 24, which is actuatable through a solenoid coil 67 connected by the double line 64 to the switch gear 61, remains withdrawn. A stop member 69 actuatable by a solenoid coil 66 which is connected by a double electric line 63 with the switch gear 61 has not yet been brought into a stop position for engaging the coil exchanging device 34.

The visible winding station of the machine unit 22 has, on the other hand, actually been set in inactive condition. An approach switch 70 has sensed the maximal or full winding of the cross-wound coil or cheese 30, and has signaled a switch gear 72 through a double electric line the switch gear 72 having accordingly excited a solenoid coil 74 through a double electric line 73 and thereby having brought a stop member 75 into stop condition. Simultaneously, the switch gear 72 has excited a solenoid coil 77 through a double electric line 76 and has thereby caused a blade 78 of the shears 24 to sever the thread 27. The severed end of the thread 27 is sucked away by the suction device 26 which is also activated by the switch gear 72, while the remaining thread end 79 continues to be wound up on the on-running cross-wound coil or cheese 30, the winding roller 28 for which has already been switched off.

The coil exchanging device 34 which travels on the rails 32 and 33 is actually in engagement at the winding station according to FIG. 2, because a stop lever 80 has been actuated by the stop member 75. The coil exchanging device 34 now appears before the winding station 81 in a position wherein the gripper 40 grips the cheese 30 at a location beneath the same.

At the instant the coil exchanging device has been placed in engagement at the winding station, the switch gear 72 sets the drive motor 47 into motion and causes the hereinafter-following operational steps through non-illustrated conventional transmissions and cam discs.

The coil frame 29 is initially opened. Then, the gripper 40 travels, guide by a gripper guide 82, vertically upwardly, accordingly entrains the fully wound cheese 30 and rolls the latter onto a trough 83 of the coil elevator 44, as shown in FIG. 4.

Then, the coil elevator 44, guided in a guidance groove 84, travels vertically into the upper terminal setting thereof. A releasing lever 85, which is connected with the elevator trough 83 and carries a slide skid 86 at an end thereof, slides itself beneath a pin 87 extending from the releasing lever 85 of the next-lying oncoming transport element 52, accordingly releases the pawl 55 and brings the coil transport hook 54 into the coil take-up position, as shown in FIG. 5. The coil transport hook 54 drawn by the articulated chain 49 in direction of the arrow shown at the top of FIG. 5 then engages or grips the coil core 88 and entrains the cheese or cross-wound coil.

In the interim, the core delivery device 42 removes an empty or unwound core from the coil core magazine 38, inserts it into the coil frame 29, and returns to the starting position thereof. The winding station 81 is ready again for a new winding operation. For this purpose, the solenoid coils 74 and 77 are de-energized and the thread end is seized, inserted into the guide trough of the winding roller 28 and affixed to the newly inserted empty or unwound coil core. Thereafter, the winding roller 28 is again set into operation and the winding operation begins anew.

While the winding station 81 has been newly rendered operative, the elevator trough 83 travels back to the starting position thereof, and the switch gear 72 gives the electric motor 36 a command to start.

The coil exchanging device 34 then swings so long past the winding stations of the textile machine until the stop lever 80 thereof is actuated by the stop of another winding station, whereupon the aforedescribed operations are repeated.

The fully wound cheese or cross-wound coil 30, which has been taken up by the transport device 48, is transported in the interim by the link chain 49 in direction of the sprocket 50 around which the chain 49 is turned.

As shown in FIG. 7, the transport element 52 travels past an approximation or approach switch 90 shortly before the former reaches the reversing location, the approach switch 90 being connected through a double electric line 91 with a switch gear 92. Another double electric line 93 extends from the switching gear 92 to an electromagnet 94 which engages a lever end 95 of the coil detent or abutment member 57. Upon the approach of the strap 53 of the transport element 52 to the approach switch 90, an electric pulse travels to the switch gear 92 and the latter then sends an excitation current into the electromagnet 94 so that the latter pulls downwardly the lever end 95 of the coil detent or abutment member 57 which is mounted with a shaft 97 in a bearing bore 98. The coil stop 57 thereby adjusts itself and places itself from the rear against the transported cross-wound coil or cheese.

With farther travel of the transport element 52, the arresting pin 89 slides high up on the upwardly sloping run-up surface 96 of the stationary slide skid 56, whereby the hook end of the coil transport hook 54 is raised, the cross-wound coil or cheese slides off the hook 54, and the latter engages the pawl 55. The coil rolls over the roll-off surface 58 onto the conveyor belt 59 which is driven by the roller 99. The coil is delivered from the conveyor belt 59 to a non-illustrated storage container.

In FIG. 8, there is shown how a cylindrical cheese or cross-wound coil rolls-off over the roll-off surface 58 onto the conveyor belt 59. The coil axis remains parallel to the original transport device during this operation.

A conically wound cheese or cross-wound coil rolls-off, on the other hand, as shown in FIG. 9. The coil lies on the conveyor belt 59 so that the axis thereof extends transversely to the original transport direction. Thereby, the coil always rolls-off, as is readily apparent from the schematically drawn FIG. 10, so that the reduced or tapered end of the cone is disposed against the roll-off surface 58. The coils thus become identically oriented quite automatically, independently of whether the individual coil originates from the left-hand or right-hand machine unit, as viewed in FIG. 1. Consequently, the thread ends, which are conventionally found with several reserve windings on the projecting thicker end of the coil core, are also always located at the side facing away from the roll-off surface 58.

There is claimed:

1. Method of operating an assembly of a coil exchanging device, means forming a travel path for the coil exchanging device extending in a given substantially horizontal direction, a cheese transport device, means forming a travel path for the cheese transport device extending in a given substantially horizontal direction above the travel path of the coil exchanging device, and means for elevating a fully wound cheese from the coil exchanging device to the cheese transport device for removing fully wound cheeses from a textile machine having machine units located on both sides of a symmetry plane and respectively formed of rows of work stations, the travel path of the coil exchange device being in the symmetry plane, the cheese transport device being located above the machine units, and the travel path thereof being at least partly in the symmetry plane, which comprises moving the coil exchange device along the travel path thereof in the symmetry plane and stopping the travel of the coil exchange device at respective work stations having fully wound cheeses, gripping respective fully wound cheeses by means of the coil exchanging device, bringing the cheeses into the symmetry plane, raising the cheeses with the elevating means to the transport device, transporting the cheese by means of the transport device along the symmetry plane above the machine units, and unloading the cheeses at an end of the textile machine.

2. Method according to claim 1 wherein the transport device has a hook-shaped transport element and which comprises, after raising the cheeses with the elevating means, hooking the cheeses with the hook-shaped element of the transport device so that the cheeses are suspended from the transport element, and thereafter performing the transporting step.

3. Method according to claim 1 wherein the assembly includes a coil receiving device and the unloading step includes rolling the cheeses in a direction transverse to the direction of travel of the transport device and downwardly therefrom onto the coil receiving device, the cheeses being oriented in such a manner that the thread ends thereof always lie at the same side independently of the machine unit from which the respective cheese originates.

* * * * *